US005797639A

United States Patent [19]

Zorzenon

[11] Patent Number: 5,797,639

[45] Date of Patent: Aug. 25, 1998

[54] LOCK BOX

[76] Inventor: Peter P. Zorzenon, 33 Park Place, Patchogue, N.Y. 11772

[21] Appl. No.: 835,328

[22] Filed: Apr. 7, 1997

[51] Int. Cl.[6] ..... B66C 3/04

[52] U.S. Cl. ..... 294/110.1; 294/112

[58] Field of Search ..... 294/90, 106, 110.1, 294/110.2, 111, 112, 115, 81.51

[56] References Cited

U.S. PATENT DOCUMENTS

| | | | |
|---|---|---|---|
| 262,330 | 8/1882 | Stone | 294/112 |
| 768,253 | 8/1904 | Watson | 294/110.1 |
| 2,776,164 | 1/1957 | Eckstein | 294/110.1 |
| 2,847,245 | 8/1958 | Leslie | 294/110.1 |
| 3,709,550 | 1/1973 | Mitchell | 294/111 |
| 4,253,695 | 3/1981 | Blaive et al. . | |
| 4,637,643 | 1/1987 | Johnson et al. . | |

FOREIGN PATENT DOCUMENTS

| | | | |
|---|---|---|---|
| 2826-871 | 1/1980 | Germany | 294/110.1 |

*Primary Examiner*—Dean Kramer
*Attorney, Agent, or Firm*—Michael I. Kroll

[57] ABSTRACT

A lock box (10) connected to a lifting device (12) having a plurality of claw-like appendages (14) radially thereabout that is suspended on the ends of chains (16) of a chain lift (18) extending from a crane (20). The lock box (10) is for shortening and lengthening the chains (16) of the chain lift (18) as needed to maintain balance and tension, by locking into place and then unlocking in a cycle during the lifting and releasing process of the claw-like appendages (14) of the lifting device (12) with a large object (22).

16 Claims, 3 Drawing Sheets

LOCK BOX

BACKGROUND OF THE INVENTION

1. Field of the Invention

The instant invention relates generally to self-releasing fastening mechanisms and more specifically it relates to a lock box. The lock box improves upon lifting processes and equipment. It is designed for use with chain and cable based lifting devices. The lock box is adapted to fit any size lifting device. It shortens or lengthens the chains or cables as needed, to maintain balance and tension. The lock box locks into place, and then unlocks in a cycle during the lifting and releasing process.

2. Description of the Prior Art

In construction, farming, road work and other outdoor jobs, lifting and moving large objects can be difficult, time consuming and manpower intensive. Many of these objects are ungainly in shape, and are not easily adapted for lifting. One example is the installation of cesspool units. To install them, they must be carefully lifted and lowered into place. One slip can result in destroyed property, and possibly even injuries. Claw-like lifting devices suspended from cranes or some type of framework grasp these objects around their edges and enable the user to pick them up and move them.

Numerous self-releasing fastening mechanisms have been provided in prior art. For example, U.S. Pat. Nos. 4,253,695 to Blaive et al. and 4,637,643 to Johnson et al. are illustrative of such prior art. While these units may be suitable for the particular purpose to which they address, they would not be as suitable for the purposes of the present invention as heretofore described.

BLAIVE, DANIEL

LAFOSSE, CLAUDE

AUTOMATIC GRAPPLE

U.S. Pat. No. 4,253,695

An automatic grapple comprising a hollow body and a slide suspended by a maneuvering cable with axially spaced portions to transform the relative movement of the slide to a displacement of gripping arms for engaging an object to be seized. The slide carries a locking member having variable orientation modified in a lower position of the slide. The position of extension or retraction of the arms is controlled by the axially spaced portions which have different diameters. The relative position of these portions is determined to permit rotation of the locking member, only if the arms can be engaged in the object to be seized or is totally disengaged therefrom.

JOHNSON, DAVID D.

BILLER, CLEVELAND J.

AUTO-RELEASE LOGGING CHOKER

U.S. Pat. No. 4,637,643

A self-releasing coupling includes a casing body to which is attached a cap portion, and in which a grasping mechanism is movably positioned. The grasping mechanism includes grapple arms rockably mounted on a piston and held thereon by a snap ring. Springs bias the piston forward and aft of the casing body and a cap shoulder and keys move the snap ring forward and aft of the grapple arm fulcrums, to bias the grapple arms into an element grasping or into an element releasing/receiving configuration. Each grapple arm includes a ramp which engages a chamfer on a casing seating shoulder, to increase the grasping force on an element as the pull or tension on that element increases. The snap ring is moved into a grapple arm opening position, while the grapple arm is grasping the element and aprons on the grapple arms engage a surface on the casing, to maintain the grapple arms in grasping engagement with the element to counter the bias of the snap ring in this mode to the device.

SUMMARY OF THE INVENTION

The lock box is a locking and releasing mechanism for a lifting device. It is simple and efficient, and it is designed to work with the lifting device such as one that is suspended on the ends of a chain lift extending from a crane to act in grabbing claw-like actions. The lock box is fabricated from steel and consists of a shaft within a square tubular casing. The shaft extends above the casing, where it attaches to a chain of the chain lift. The shaft slides up and down freely within the casing and is guided by two bushings, one of which is located at the top of the casing, while the other is about the shaft above the bottom of the casing.

A swing arm is attached on a pivotal yoke to the bottom of the shaft inside the casing. The shape of the swing arm being slightly hooked, causes it to move to one side of its attachment to the shaft. Angular wedges attached in a vertical series at the bottom of the casing, and underneath the swing arm cause the swing arm to lock into place inside the casing. The angular wedges form a chevron-like track between them that guides a horizontal crossbar in the tip of the swing arm into and out of a locked position underneath of the angled tip of the upper wedge. A deflector arm rests between the swing arm and the wedges to block the swing arm in a raised position and guide it to the locked position when it lowers toward the wedges.

When the swing arm and shaft are locked in place at the bottom of the casing, it creates a downward tension on the chain of the chain lift attached to the top of the shaft. The chain lift suspends the lifting device from the crane. The tension would, in turn, hold the hooking claw-like appendages of the lifting device in a released open position. When the shaft is released and allowed to slide upward in the casing, it releases the tension on the chain of the chain lift attached to the shaft. This allows the claw-like appendages of the lifting device to close around the object they will lift.

A primary object of the present invention is to provide a lock box that will overcome the shortcomings of the prior art devices.

Another object is to provide a lock box that functions as an individually operated automatic locking and release mechanism that responds to the action of a lifting device.

An additional object is to provide a lock box having the convenience of being able to maneuver heavy loads more quickly and efficiently.

A further object is to provide a lock box that is simple and easy to use.

A still further object is to provide a lock box that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
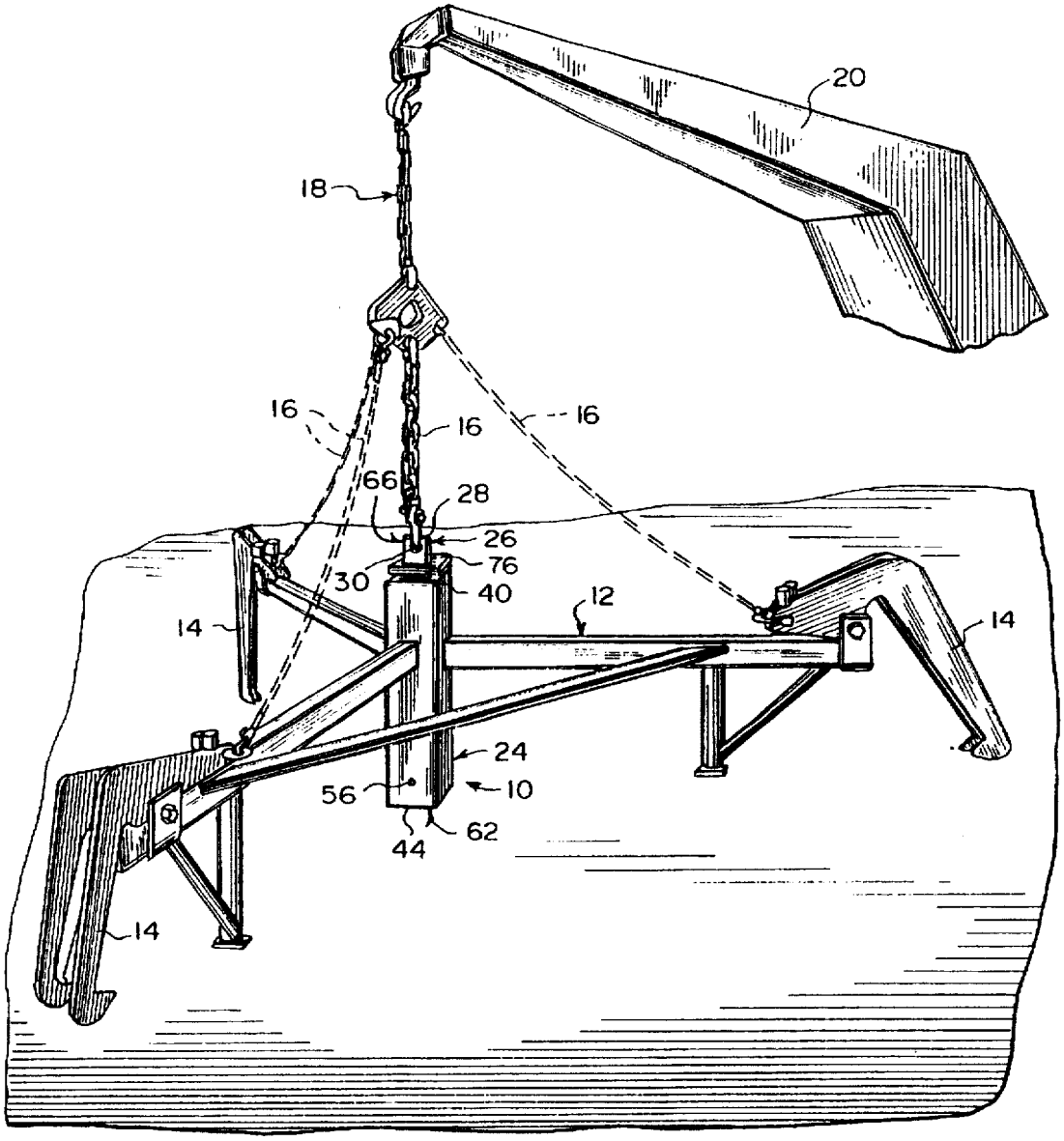
FIG. 1 is a perspective view showing the instant invention in a lifting device in a locked condition, to keep the lifting device in a released opened position.
Figure 2:
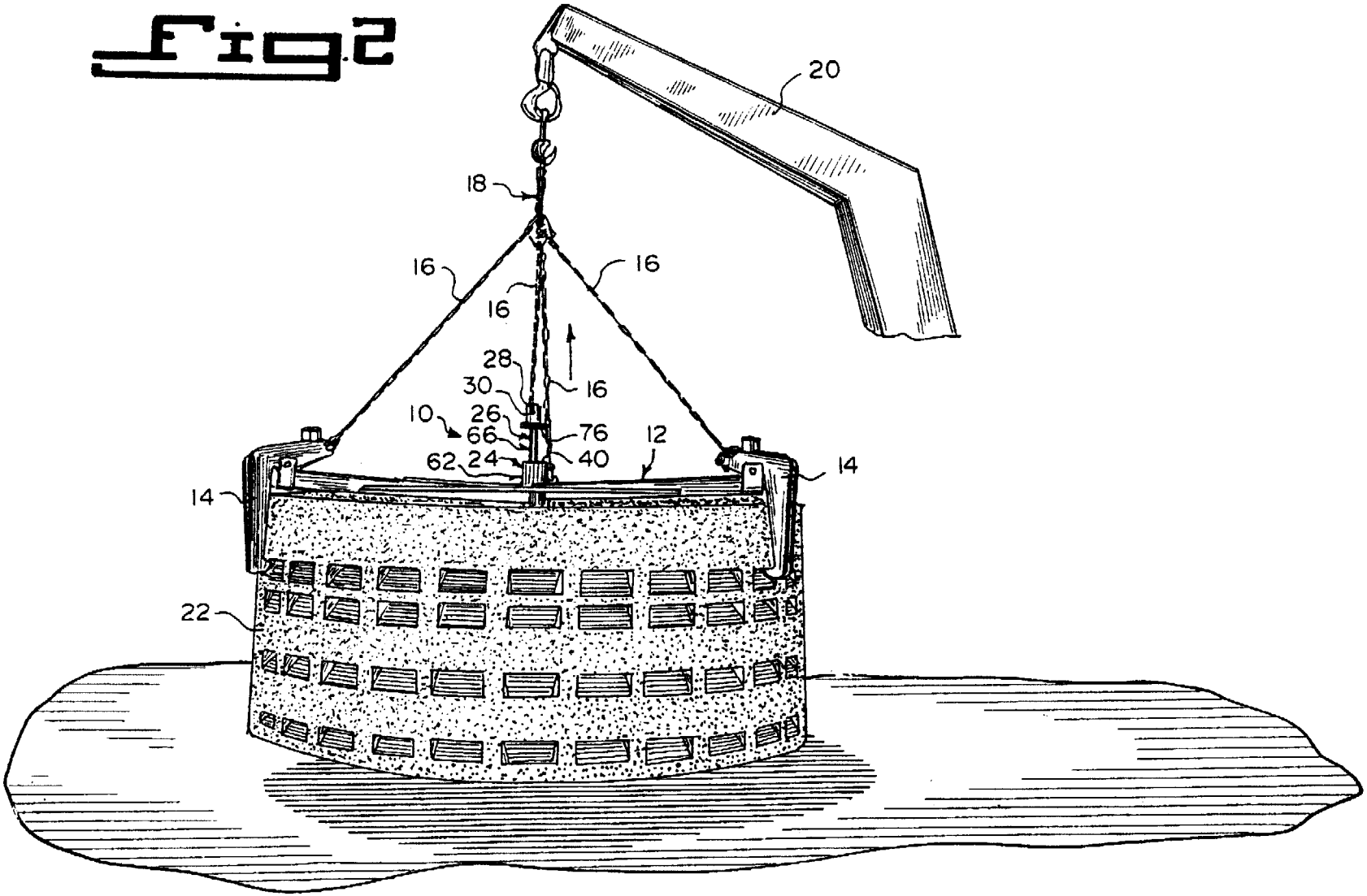
FIG. 2 is a perspective view showing the instant invention in the lifting device in an unlocked condition, to keep the lifting device in a gripping closed position on a cesspool unit.
Figure 3:
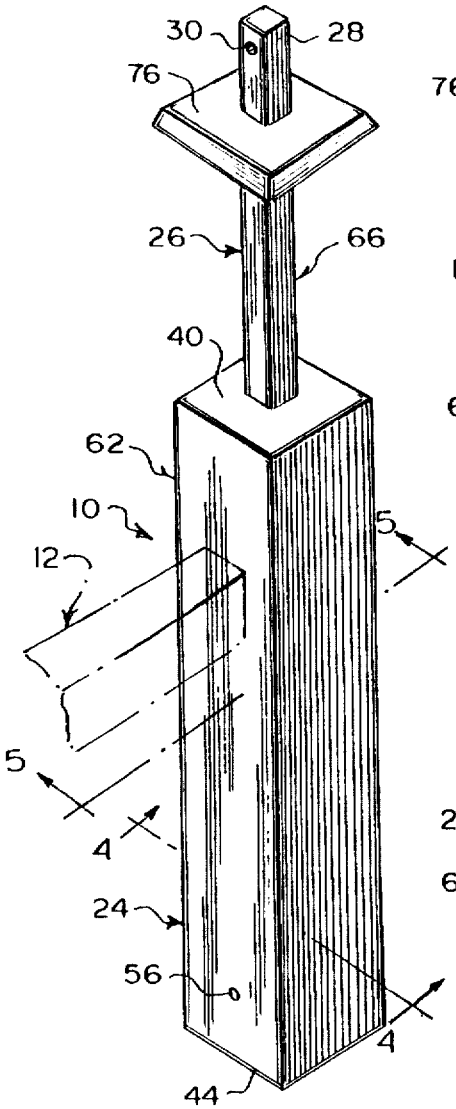
FIG. 3 is an enlarged perspective view of the instant invention per se in the unlocked position.

Turning now descriptively to the drawings, in which similar reference characters denote similar elements throughout the several views, FIGS. 1 through 5 illustrate a lock box 10 connected to a lifting device 12, having a plurality of claw-like appendages 14 radially thereabout that is suspended on the ends of chains 16 of a chain lift 18 extending from a crane 20. The lock box 10 is for shortening and lengthening the chains 16 of the chain lift 18 as needed to maintain balance and tension, by locking into place and then unlocking in a cycle during the lifting and releasing process of the claw-like appendages 14 of the lifting device 12 with a large object 22, such as a cesspool unit, shown in FIG. 2.

Figure 5:
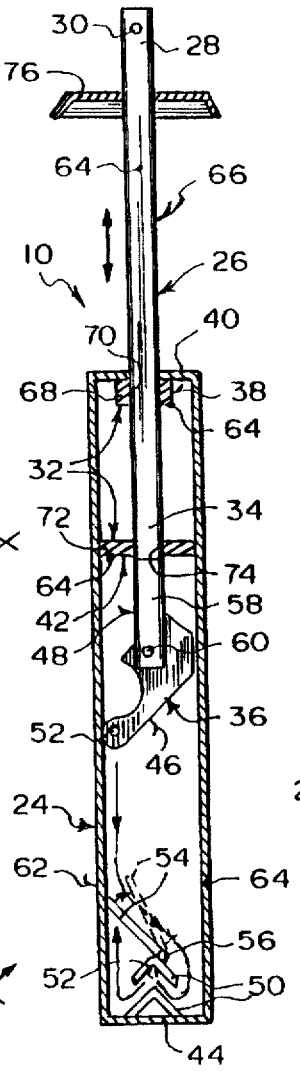
FIG. 5 is a cross sectional view taken along line 5—5 in FIG. 3.
Figure 4:
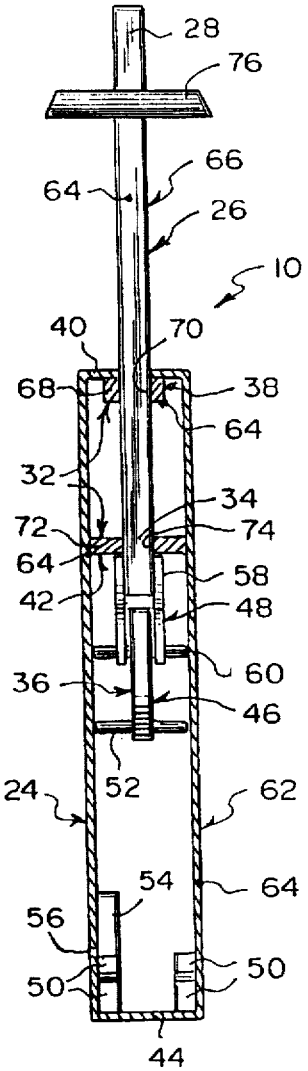
FIG. 4 is a cross sectional view taken along line 4—4 in FIG. 3.

The lock box 10, as best seen in FIGS. 4 and 5, includes a casing 24 connected vertically and centrally with the lifting device 12. An elongated shaft 26 has an upper end 28 with a shackle hole 30 connected to the chain 16 of the chain lift 18. An assembly 32 is for guiding a lower end 34 of the elongated shaft 26 vertically within the casing 24, so that the upper end 28 of the elongated shaft 26 will extend out above the casing 24.

A facility 36 is for locking and unlocking the elongated shaft 26 within the casing 24. When the elongated shaft 26 goes to the bottom of the casing 24, it will be locked therein to create a downward tension on the chain 16 of the chain lift 18 to hold the claw-like appendages 14 of the lifting device 12 in a released open position, as in FIG. 1. When the elongated shaft 26 is unlocked at the bottom of the casing 24 to release tension on the chain 16 of the chain lift 18, it will allow the claw-like appendages 14 of the lifting device 12 to close around the large object 22 when lifted.

The guiding assembly 32 consists of a first bushing 38 mounted to the underside of a top end 40 of the casing 24. A second bushing 42 is mounted within the casing 24 to sides thereof spaced above a bottom end 44 of the casing 24, so that the elongated shaft 26 can slide through the first bushing 38 and the second bushing 42.

The locking and unlocking facility 36 comprises a swing arm 46 having a shape that is slightly hooked. An assemblage 48 is for pivotally attaching the swing arm 46 to the lower end 34 of the elongated shaft 26 within the casing 24. The swing arm 46 being slightly hooked will cause it to move to one side of the pivotally attaching assemblage 48. A plurality of angular wedges 50 are attached in a vertical series at the bottom end 44 of the casing 24 and underneath the swing arm 46. The angular wedges 50 form a chevron-like track therebetween.

A horizontal crossbar 52 in a lower tip end of the swing arm 46 can be guided into and out of a locked position underneath an inverted corner of the upper angular wedges 50. A deflector arm 54 is pivotally connected at 56 within the casing 24 between the swing arm 46 and directly above the angular wedges 50 to block the crossbar 52 in the swing arm 46, when in a raised position and guide the crossbar 52 in the swing arm 46 to the locked position, when the swing arm 46 is lowered by the elongated shaft 26 towards the angular wedges 50. When the swing arm 46 is unlocked and raised by the elongated shaft 26, the deflector arm 54 will pivot away to allow passage of the swing arm 46.

The pivotally attaching assemblage 48 includes a yoke member 58 connected to the lower end 34 of the elongated shaft 26. A pivot pin 60 extends through the yoke member 58 and an upper end of the swing arm. The casing 24 is a rectangular hollow member 62 fabricated out of a durable strong material 64. The elongated shaft 26 is a rectangular flat bar 66 fabricated out of the durable strong material 64.

The first bushing 38 is a small square plate 68, having a central aperture 70 to allow the elongated shaft 26 to slide therethrough and fabricated out of the durable strong material 64. The second bushing 42 is a large square plate 72, having a central aperture 74 to allow the elongated shaft 26 to slide therethrough and fabricated out of the durable strong material 64. The lock box 10 further contains a dust cover 76 mounted onto the elongated shaft 26 adjacent the upper end 28 thereof.

A number of possible modifications to the basic concept of the instant invention are suggested to augment the usefulness and the popularity of the lock box 10, as well as to help solve any problems that might arise. The lock box 10 could be used with helicopters, while it also could have applications in logging and quarry work. The lock box 10 might be produced in a variety of sizes, and from a variety of materials, depending on the application. Overall, the basic concept behind the lock box 10 appears to be sound and the product idea workable. The basic materials are readily obtainable, and the notion of the lock box 10 being a locking and release mechanism for a lift device 12, could have a strong market appeal in heavy industries.

LIST OF REFERENCE NUMBERS

10 lock box
12 lifting device
14 claw-like appendage of 12
16 chain of 18
18 chain lift
20 crane
22 large object
24 of 10
26 elongated shaft of 10
28 upper end of 26
30 shackle hole in 28

32 guiding assembly of 10
34 lower end of 26
36 locking and unlocking facility of 10
38 first bushing of 32
40 top end of 24
42 second bushing of 32
44 bottom end of 24
46 swing arm of 36
48 pivotally attaching assemblage of 36
50 angular wedge of 36
52 horizontal crossbar of 36
54 deflector arm of 36
56 pivot
58 yoke member of 48
60 pivot pin of 48
62 rectangular hollow member for 24
64 durable strong material for 62, 66, 68, 72
66 rectangular flat bar for 26
68 small square plate for 38
70 central aperture in 68
72 large square plate for 42
74 central aperture in 72
76 dust cover on 26

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A lock box connected to a lifting device having a plurality of claw-like appendages radially therealong that is suspended on the ends of chains of a chain lift extending from a crane, said lock box is for shortening and lengthening the chains of the chain lift as needed to maintain balance and tension, by locking into place and then unlocking in a cycle during the lifting and releasing process of the claw-like appendages of the lifting device with a large object, wherein said lock box includes:

a) a casing connected vertically and centrally with the lifting device;

b) an elongated shaft having an upper end with a shackle hole connected to one of the chains of the chain lift;

c) means for guiding a lower end of said elongated shaft vertically within said casing, so that the upper end of said elongated shaft will extend out above said casing; and d) means for locking and unlocking said elongated shaft within said casing, so that when said shaft goes to the bottom of said casing it will be locked therein to create a downward tension on one of the chains of the chain lift to hold the claw-like appendages of the lifting device in a released open position, until said elongated shaft is unlocked at the bottom of said casing to release tension on the chain of the chain lift to allow the claw-like appendages of the lifting device to close around the large object when lifted.

2. A lock box as recited in claim 1, wherein said locking and unlocking means includes:

a) a swing arm having a shape that is slightly hooked;

b) means for pivotally attaching said swing arm to the lower end of said elongated shaft within said casing, whereby said swing arm being slightly hooked will cause it to move to one side of said pivotally attaching means;

c) a plurality of angular wedges attached in a vertical series at the bottom end of said casing and underneath said swing arm, whereby said angular wedges form a chevron-like track therebetween;

d) a horizontal crossbar in a lower tip end of said swing arm which can be guided into and out of a locked position underneath an inverted corner of said upper angular wedges; and e) a deflector arm pivotally connected within said casing between said swing arm and directly above said angular wedges to block said crossbar in said swing arm when in a raised position and guide said crossbar in said swing arm to the locked position when said swing arm is lowered by said elongated shaft towards said angular wedges, whereby when said swing arm is unlocked and raised by said elongated shaft said deflector arm will pivot away to allow passage of said swing arm.

3. A lock box as recited in claim 2, wherein said pivotally attaching means includes:

a) a yoke member connected to the lower end of said elongated shaft; and b) a pivot pin extending through said yoke member and an upper end of said swing arm.

4. A lock box as recited in claim 1, wherein said casing is a rectangular hollow member fabricated out of a durable strong material.

5. A lock box as recited in claim 1, wherein said elongated shaft is a rectangular flat bar fabricated out of a durable strong material.

6. A lock box as recited in claim 1, further including a dust cover mounted onto said elongated shaft adjacent the upper end thereof.

7. A lock box as recited in claim 1, wherein said guiding means includes:

a) a first bushing mounted to the underside of a top end of said casing; and b) a second bushing mounted within said casing to sides thereof spaced above a bottom end of said casing, so that said elongated shaft can slide through said first bushing and said second bushing.

8. A lock box as recited in claim 7, wherein said first bushing is a small square plate having a central aperture to allow said elongated shaft to slide therethrough, and fabricated out of a durable strong material.

9. A lock box as recited in claim 7, wherein said second bushing is a large square plate having a central aperture to allow said elongated shaft to slide therethrough and fabricated out of a durable strong material.

10. A lock box as recited in claim 7, wherein said locking and unlocking means includes:

a) a swing arm having a shape that is slightly hooked;

b) means for pivotally attaching said swing arm to the lower end of said elongated shaft within said casing, whereby said swing arm being slightly hooked will cause it to move to one side of said pivotally attaching means;

c) a plurality of angular wedges attached in a vertical series at the bottom end of said casing and underneath said swing arm, whereby said angular wedges form a chevron-like track therebetween;

d) a horizontal crossbar in a lower tip end of said swing arm which can be guided into and out of a locked position underneath an inverted corner of said upper angular wedges; and e) a deflector arm pivotally connected within said casing between said swing arm and directly above said angular wedges to block said crossbar in said swing arm when in a raised position and guide said crossbar in said swing arm to the locked position when said swing arm is lowered by said elongated shaft towards said angular wedges, whereby when said swing arm is unlocked and raised by said elongated shaft said deflector arm will pivot away to allow passage of said swing arm.

11. A lock box as recited in claim 10, wherein said pivotally attaching means includes:

a) a yoke member connected to the lower end of said elongated shaft; and b) a pivot pin extending through said yoke member and an upper end of said swing arm.

12. A lock box as recited in claim 11, wherein said casing is a rectangular hollow member fabricated out of a durable strong material.

13. A lock box as recited in claim 12, wherein said elongated shaft is a rectangular flat bar fabricated out of a durable strong material.

14. A lock box as recited in claim 13, wherein said first bushing is a small square plate having a central aperture to allow said elongated shaft to slide therethrough, and fabricated out of a durable strong material.

15. A lock box as recited in claim 14, wherein said second bushing is a large square plate having a central aperture to allow said elongated shaft to slide therethrough and fabricated out of a durable strong material.

16. A lock box as recited in claim 15, further including a dust cover mounted onto said elongated shaft adjacent the upper end thereof.

* * * * *